US006889414B2

(12) United States Patent
Korsedal

(10) Patent No.: US 6,889,414 B2
(45) Date of Patent: May 10, 2005

(54) REUSABLE RETAINER AND ASSEMBLY

(75) Inventor: James B. Korsedal, Holly, MI (US)

(73) Assignee: General Motors Corporation, Detroit, MI (US)

( * ) Notice: Subject to any disclaimer, the term of this patent is extended or adjusted under 35 U.S.C. 154(b) by 59 days.

(21) Appl. No.: 10/445,624

(22) Filed: May 27, 2003

(65) Prior Publication Data

US 2004/0237281 A1 Dec. 2, 2004

(51) Int. Cl.[7] ..... B25B 27/14
(52) U.S. Cl. ..... 29/281.5; 29/271
(58) Field of Search ..... 29/525, 281.5, 29/464, 271, 525.11, 426.1; 280/728.2; 411/173, 174; 269/309

(56) References Cited

U.S. PATENT DOCUMENTS 5,501,484 A * 3/1996 Saderholm et al. ..... 280/728.2

6,443,677 B1 * 9/2002 Patterson, Jr. ..... 411/174

* cited by examiner

*Primary Examiner*—John C. Hong
(74) *Attorney, Agent, or Firm*—Leslie C. Hodges

(57) ABSTRACT

A retainer for positioning and retaining flanged nuts relative to a member for installation on studs of a larger assembly. The retainer includes a body and nut retaining tabs extending from the body. Each tab loosely carries a flanged nut. The member has a body with a plurality of openings spaced to be received on a plurality of threaded studs. The retainer and captured nuts are attached to the member to form a retainer assembly, which holds the member and nuts together until the member is installed on the studs of the larger assembly. The retainer assembly is positioned on a plurality of studs and the nuts are threaded onto the studs. The nut retainer is then removed from the member, leaving the member attached to the studs. The retainer may then be reused to install similar members.

11 Claims, 9 Drawing Sheets

REUSABLE RETAINER AND ASSEMBLY

TECHNICAL FIELD

This invention relates to retainers and, more specifically, to a nut retainer for holding a member and fastener in temporary assembly for installation of the member on studs of a larger assembly.

BACKGROUND OF THE INVENTION

Nut retainers are known in the art and, in a current embodiment, comprise a metal strip having a series of nut receptacles extending from the length of the strip. The receptacles hold a series of nuts in predetermined positions against a metal sheet for assembly. The current receptacles require special nuts having necked down portions or other special features, which can increase the cost of using a nut retainer.

Additionally, the current nut retainers are permanently attached to the metal sheet by welding or riveting, and thus not reusable. This adds mass and cost to the part and can interfere with the mounting of additional components.

SUMMARY OF THE INVENTION

The present invention provides a low cost reusable nut retainer for positioning and retaining standard flanged nuts relative to a member for installation on studs of an assembly. The member has a body and a plurality of openings extending through the body, which are spaced to be received on a plurality of threaded studs of an assembly such as an engine crankcase subassembly.

The retainer has a body with a releasable attachment for releasably holding the retainer in place on the member. A plurality of tabs extend from the body of the retainer, and each tab has an opening for receiving a flanged nut. The openings are large enough to loosely surround the driving portion of a nut while engaging the flange portion of the nut. The size of each opening provides alignment room and allows the nut to rotate inside the tab, but allows the tab to engage the flange to prevent the nut from falling out of the tab.

Before attachment, the retainer is inverted and flanged nuts are placed inside the tabs with the retainer inverted so that the nuts partially extend through the tabs and the flanges hold the nuts in place. The member is clipped to the inverted retainer using the releasable attachment of the retainer to form a retainer assembly. When the retainer and the member are clipped together, the nuts are retained in alignment with the openings of the member and the nuts are positioned so that the flange portions face the member.

During installation, the retainer assembly is positioned against a larger assembly or structure having a plurality of studs so the studs extend through the openings of the member and engage the nuts. The studs lift the nuts inside the tabs until the flanges of the nuts engage the tabs. Clearance between the tab openings and the nuts provides the nuts with alignment movement to correct assembly tolerances. The nuts are then threaded onto the studs and the retainer is detached from the assembly so that it can be reused in the same manner on another member.

These and other features and advantages of the invention will be more fully understood from the following description of certain specific embodiments of the invention taken together with the accompanying drawings.

DESCRIPTION OF THE PREFERRED EMBODIMENT

Figure 1:
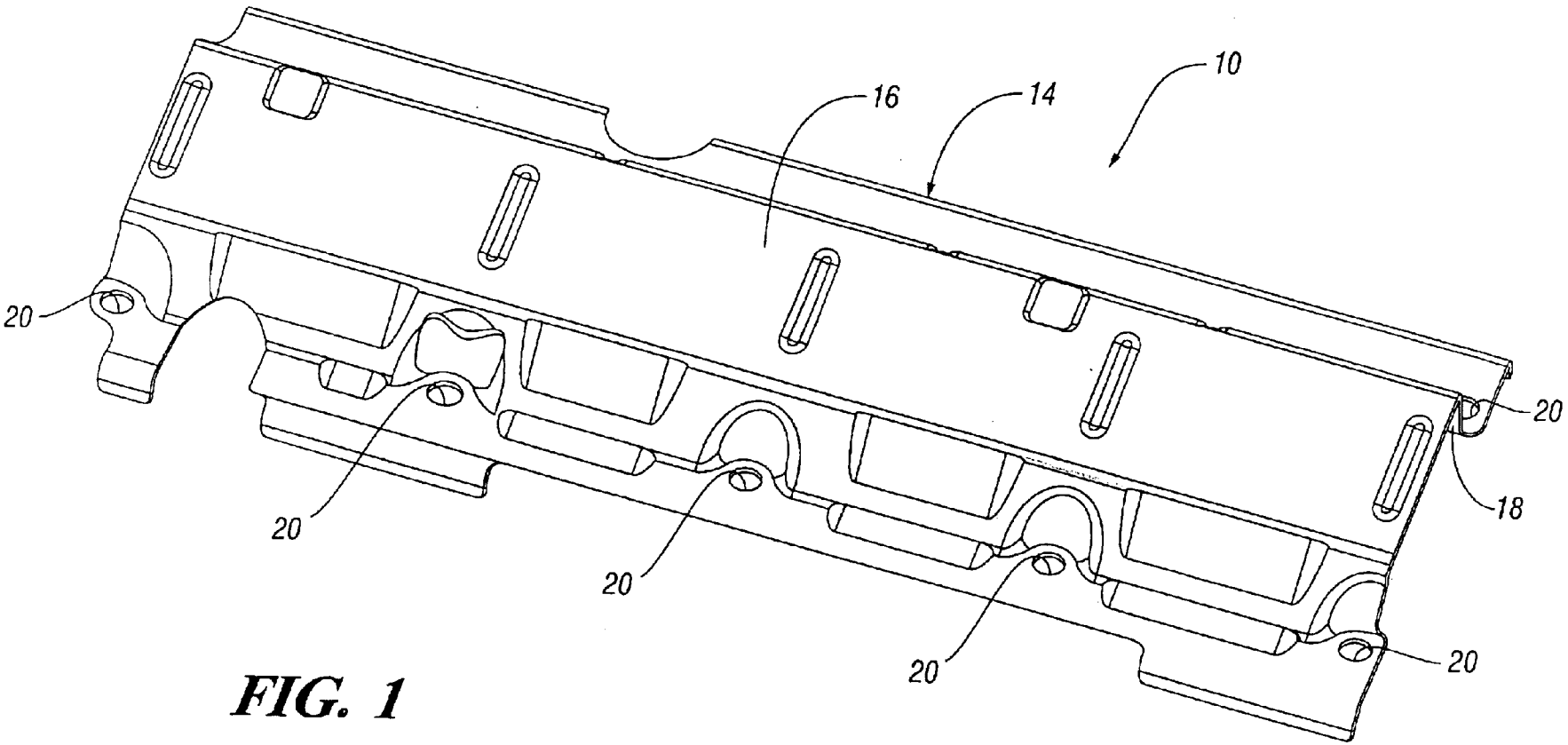
FIG. 1 is a pictorial view of an engine oil deflector having a plurality of holes.

Referring first to FIGS. 1 and 6–9 of the drawings in detail, numeral 10 generally indicates an oil deflector, which is adapted to be mounted to threaded studs 12 extending from crankshaft main bearing caps, not shown, in a simulated engine crankcase 13. The deflector 10 has a body 14 having upper and lower surfaces 16, 18. A plurality of openings 20 extend through the body 14 for receiving studs 12.

The deflector 10 is positioned so that the studs 12 of the crankcase extend through the deflector openings 20. A standard flanged nut 22 having an internally threaded opening 24, a driving portion 26, and a flange 28 is threaded onto each stud 12 individually to secure the deflector 10 to the engine.

Figure 2:
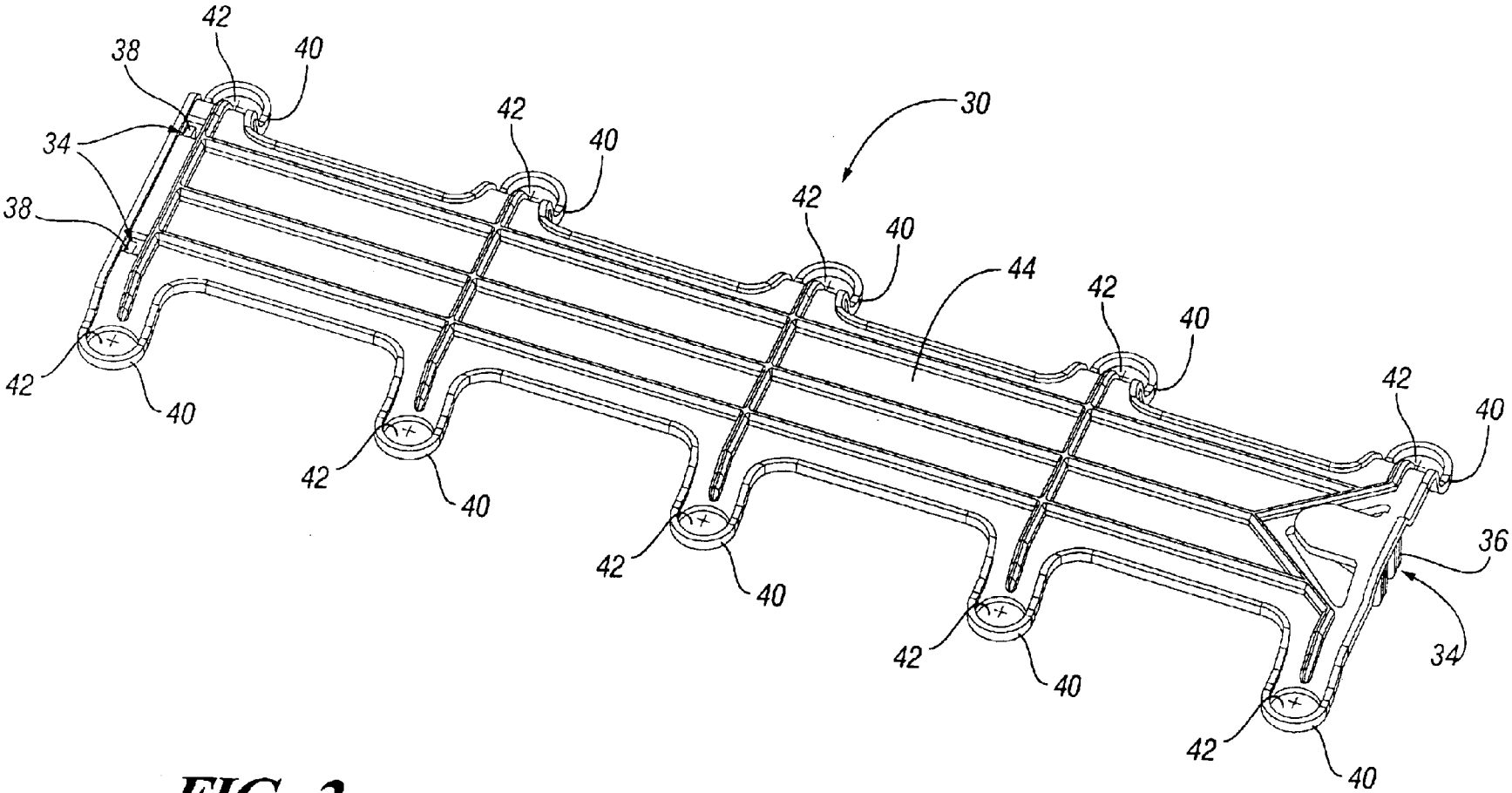
FIG. 2 is a pictorial view of a retainer according to the present invention.
Figure 3:
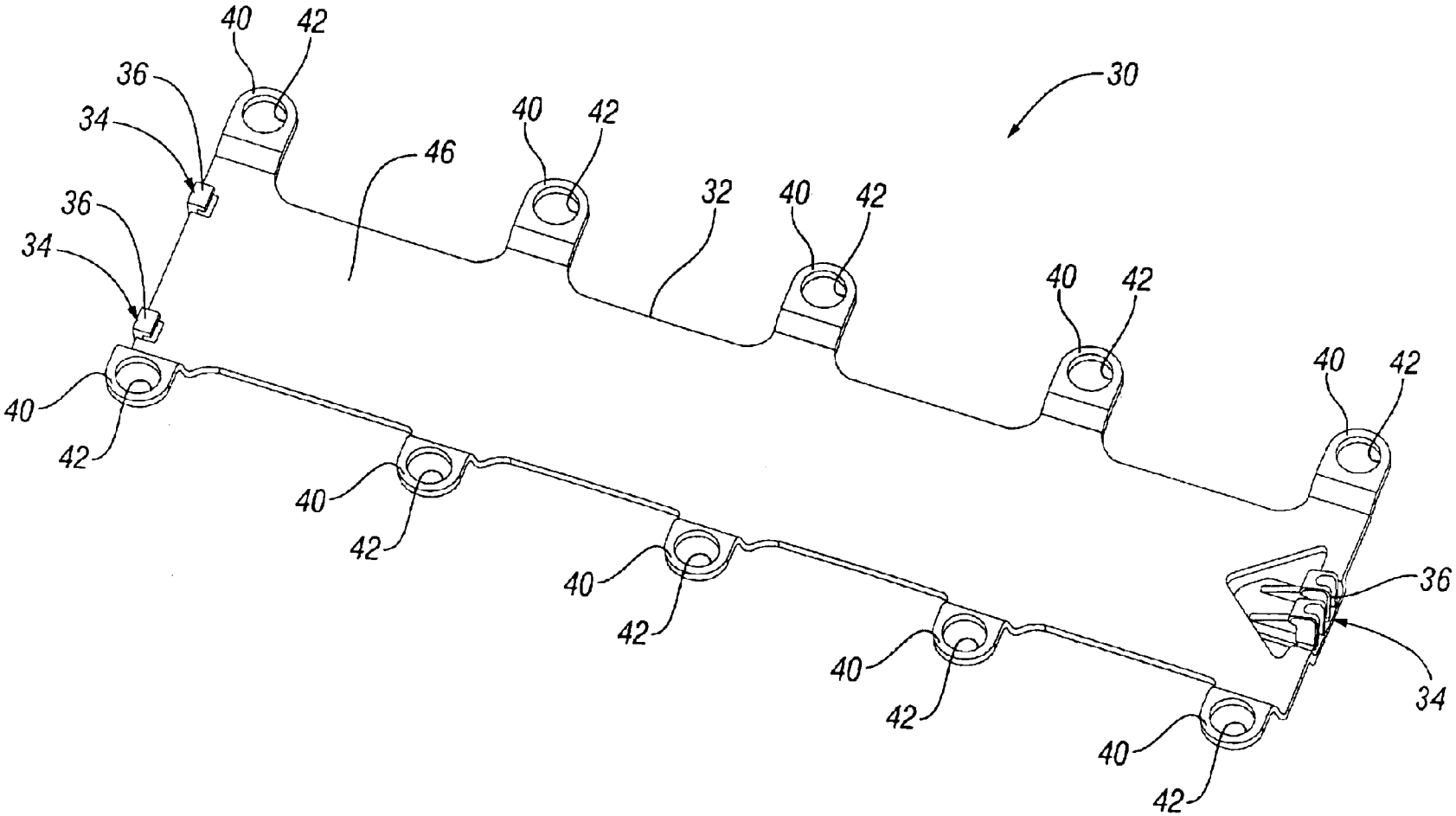
FIG. 3 is a pictorial view shown inverted and disclosing the attachment elements of the retainer of FIG. 2.

FIGS. 2 and 3 show a nut retainer 30 according to the present invention. The nut retainer 30 has a relatively flat longitudinally and laterally extending molded plastic body 32 having a releasable attachment 34 including an integrally molded flexible latch 36 and retaining hooks 38 formed on opposite ends of the body 32. A plurality of retaining tabs 40 extend from the body 32. Each tab 40 has an opening 42 for retaining flanged nuts 22. The body 32 of the retainer 30 has upper and lower surfaces 44, 46. The shape of the body 32 may be varied to accommodate the part or member to which it is attached. The retainer 30 is preferably made from a semi-resilient plastic, but may also be formed of other durable materials.

The openings 42 of the tabs 40 are spaced to hold nuts 22 in alignment with the openings 20 of the oil deflector 10. The tab openings 42 surround the driving portions 26 of the nuts 22 while retaining the flanges 28. Clearance between the driving portions 26 of the nuts 22 and the openings 42 in the tabs 40 allows the nuts 22 to rotate inside the tabs 40. The clearance also provides the nuts 22 with alignment movement to accommodate assembly tolerances. However, tabs 40 form abutments against the flanges 28 of the nuts 22 to prevent the nuts 22 from passing through the tabs 40.

FIG. 3 further discloses the releasable attachment 34 of the retainer 30, which releaseably attaches the retainer 30 to the deflector 10. The attachment 34 includes the retaining hooks 38 extending from the lower surface 46 at one end of the body 32 and the latch 36 at an opposite end.

Figure 4:
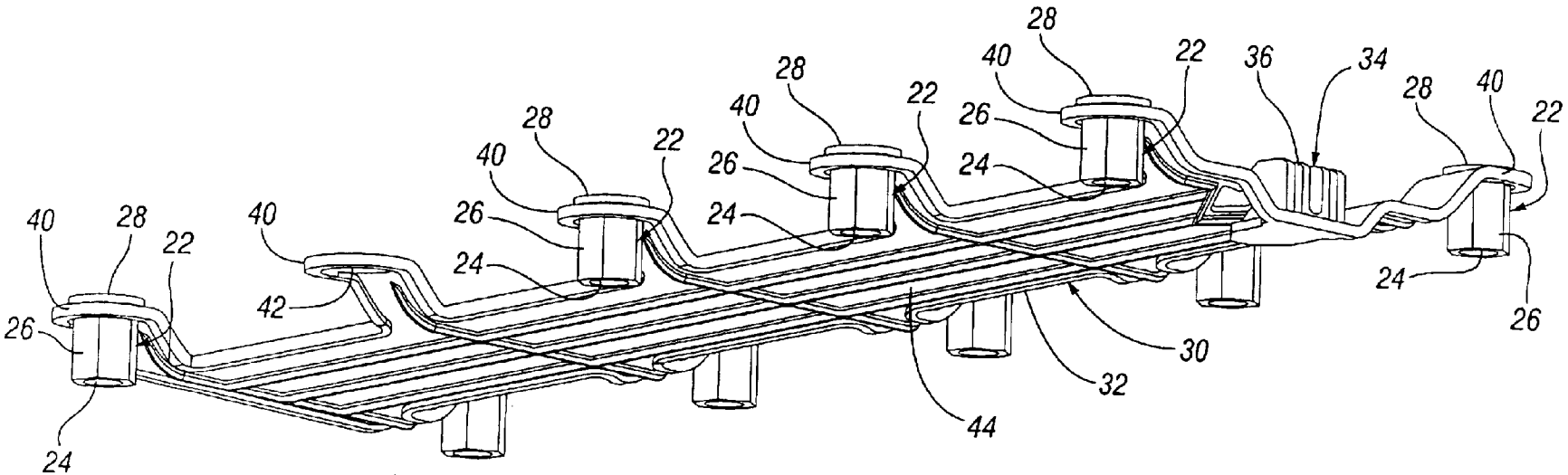
FIG. 4 is a pictorial view showing a plurality of nuts held inside the tabs of the inverted retainer of FIG. 3 before assembly to the deflector plate of FIG. 1.

FIG. 4 shows the retainer 30 inverted holding a plurality of nuts 22 positioned inside the tabs 40 so that the driving portions 26 of the nuts 22 extend through the tabs 40 and the flanges 28 of the nuts 22 engage the lower surfaces of the tabs 40. The contact between the flanges 28 and the tabs 40 holds the nuts 22 inside tabs 40. The retainer 30 must remain inverted until an oil deflector 10 is attached to the retainer 30.

Figure 5:
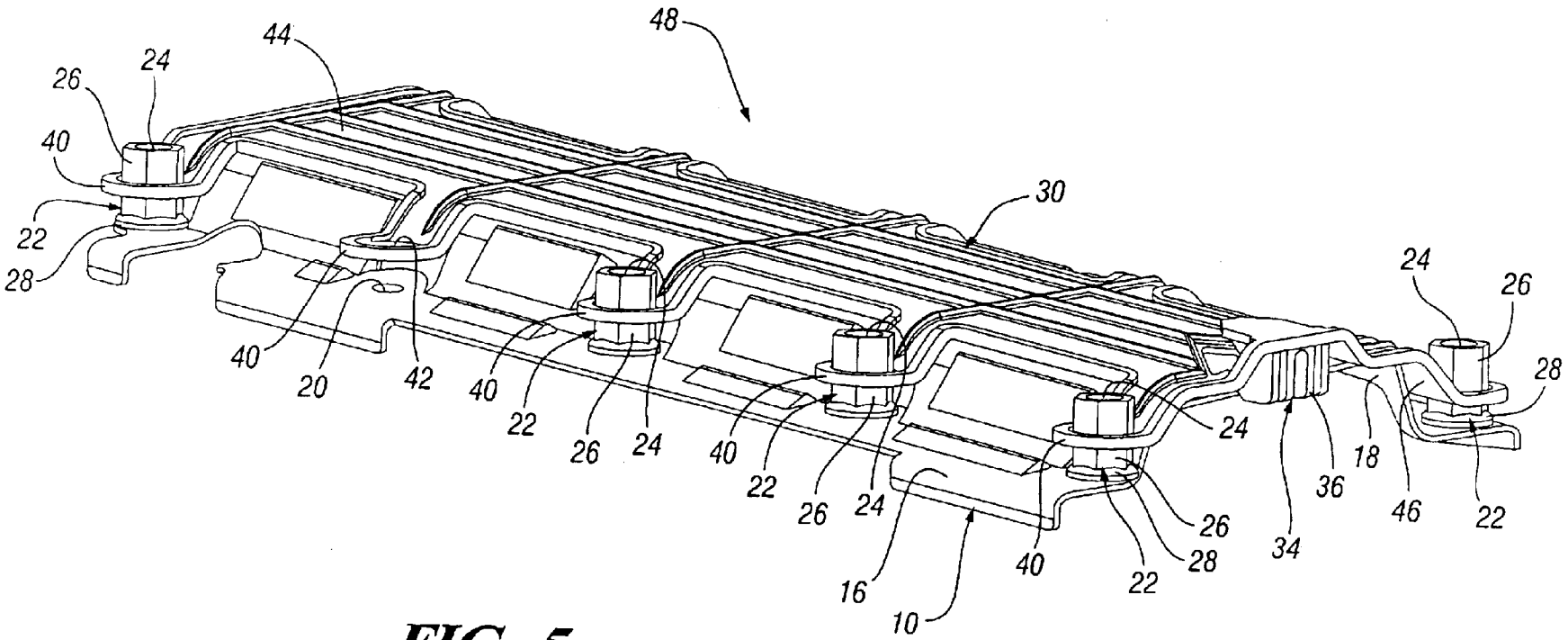
FIG. 5 is pictorial view showing a retainer assembly including the retainer of FIG. 2 attached to the oil deflector of FIG. 1.

FIG. 5 shows a retainer assembly 48 including the oil deflector 10 clipped to the retainer 30 with hooks 38 of the retainer 30 overlapping one end of the deflector 10 and latch 36 of the retainer 30 overlapping the opposite end of the deflector 10. The nuts 22 also form part of the assembly 48 and are held in place between the upper surface 16 of the deflector 10 and the retaining tabs 40 of the retainer 30.

The tabs 40 of the retainer 30 are spaced a distance from the upper surface 16 of the deflector 10 while the lower surface 46 of the retainer 30 engages the upper surface 16 of the deflector 10. The spaces between the tabs 40 and the deflector 10 allow the nuts 22 to float for a distance inside the tabs 40. The distance between the tabs 40 and the upper surface 16 of the deflector 10 is less than the height of nuts 22. Thus, the driving portions 26 of the nuts 22 extend through the tabs 40 to engage a driver, not shown, when the flanges 28 of the nuts 22 engage the upper surface 16 of the deflector 10. This prevents the tabs 40 from interfering with the driver.

Figure 6:
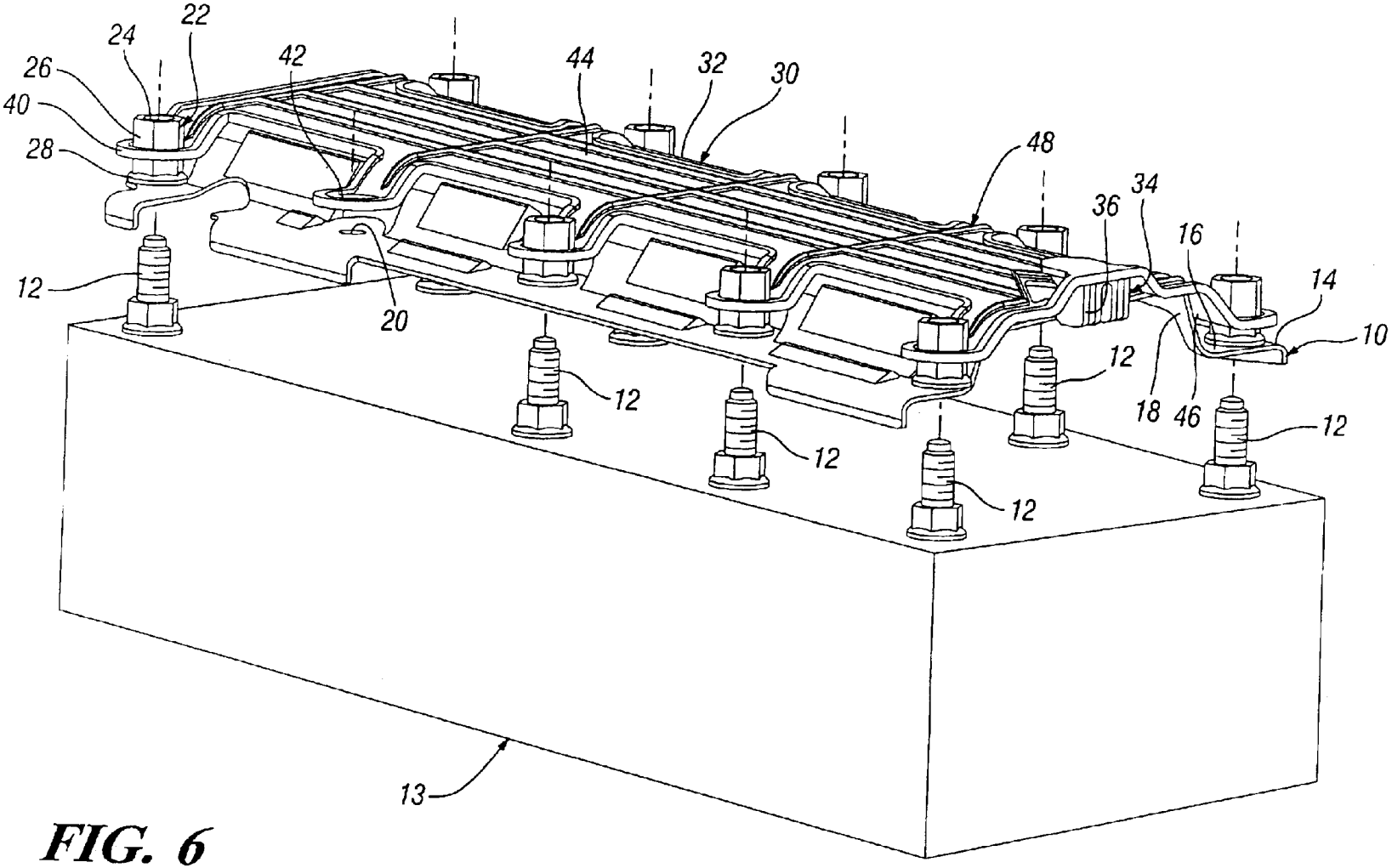
FIG. 6 is a pictorial view of the retainer assembly of FIG. 5 positioned over a plurality of threaded studs extending from a simulated automotive engine crankcase.
Figure 7:
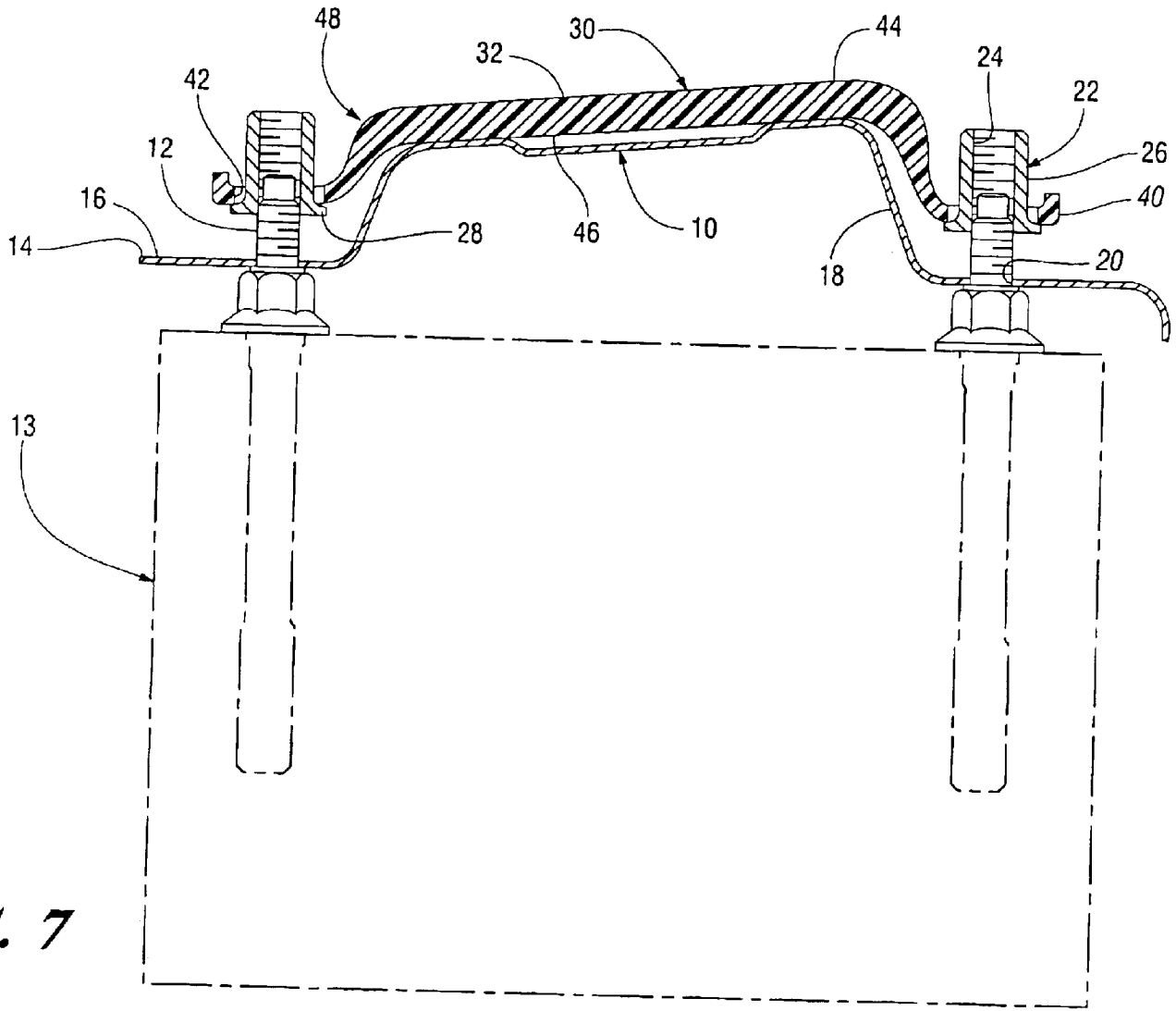
FIG. 7 is a cross-sectional view showing the nuts positioned on the ends of the studs.

FIG. 6 shows the retainer assembly 48 positioned over the threaded studs 12 prior to installation of the oil deflector 10. The positioned assembly 48 is then lowered onto the threaded studs 12. As assembly 48 is lowered onto the studs 12, the studs 12 extend through the openings 20 of the deflector 10 and engage the threaded openings 24 of the nuts 22. As the studs engage the nuts 22, the nuts 22 are pushed through the tabs 40 until the flanges 28 of the nuts 22 engage the tabs 40, as shown in FIG. 7. As the nuts 22 move inside the tabs 40 the threaded openings 24 align with the threaded studs 12 to accommodate assembly tolerance.

Figure 8:
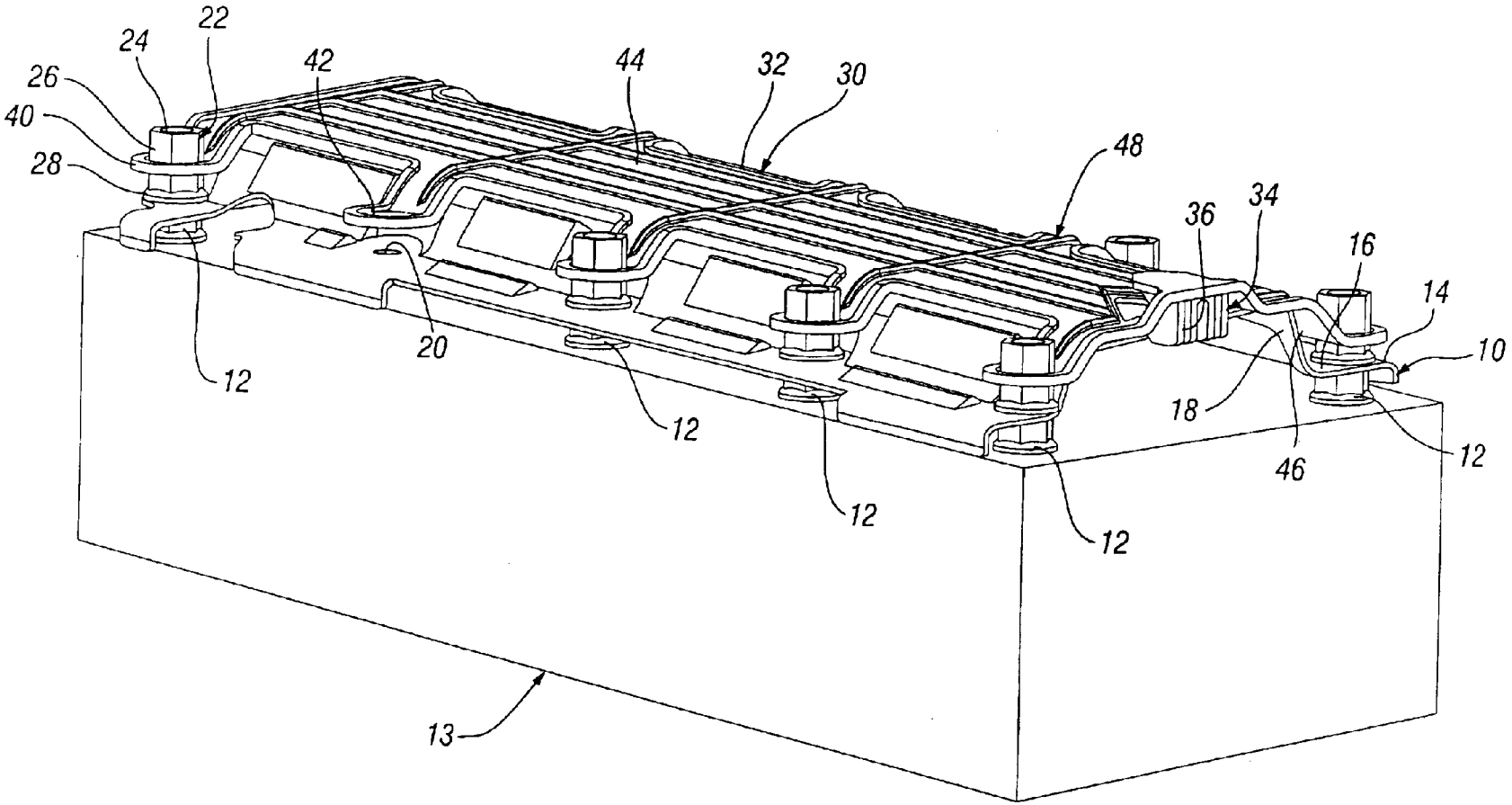
FIG. 8 is a pictorial view of the nut retainer and oil deflector fastened to the simulated crankcase.
Figure 9:
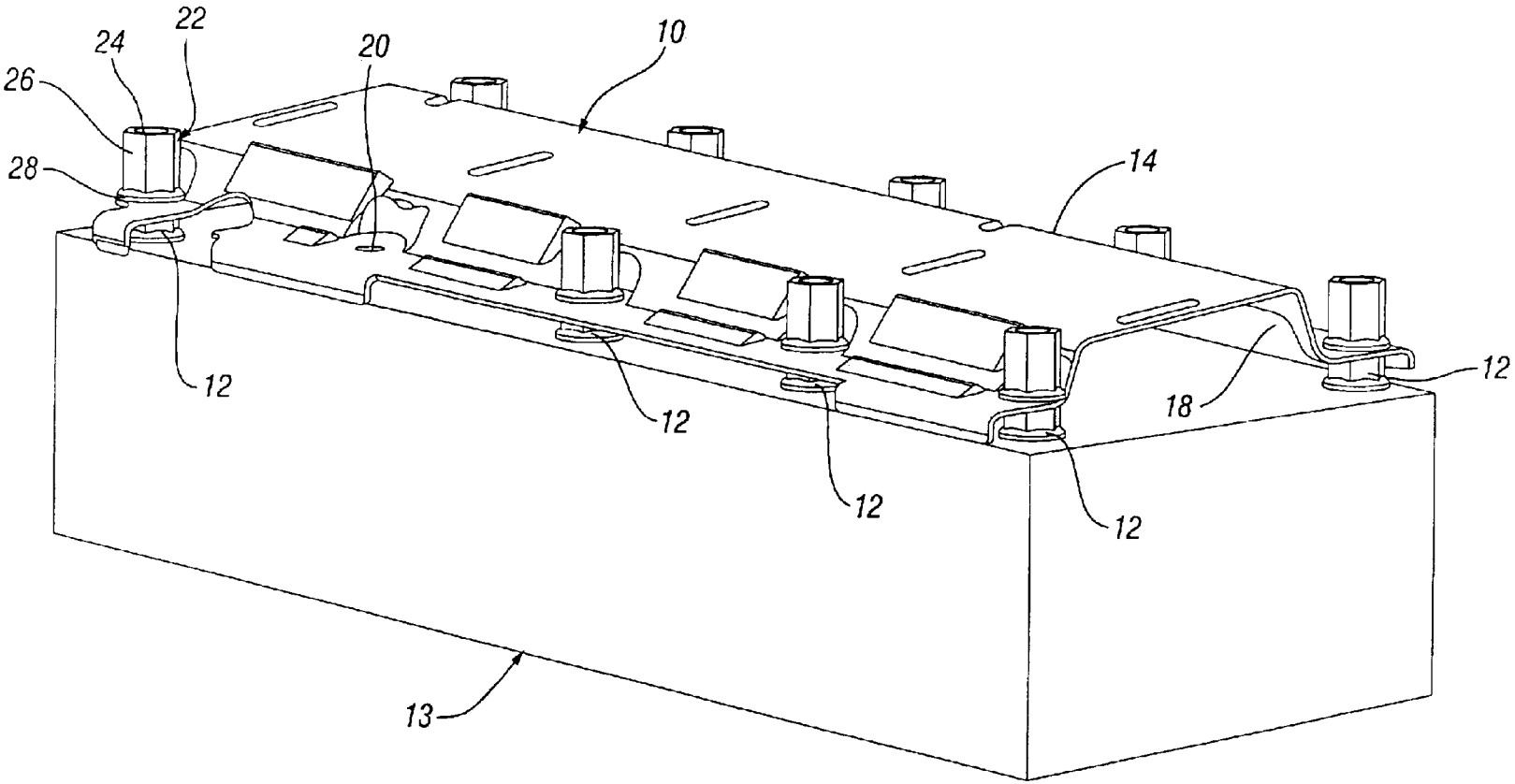
FIG. 9 is a pictorial view of the oil deflector of FIG. 1 fastened to the simulated crankcase after the retainer of FIG. 2 is removed.

The nuts 22 are then threaded onto the studs 12 by a nut driver, not shown. The nuts 22 move downward through the tabs 40 until the flanges 28 engage the upper surface 16 of the deflector 10, as shown in FIG. 8. After all of the nuts 22 are threaded onto the studs 12, the retainer 30 is removed from the deflector 10 by disconnecting latch 36 and lifting the retainer 30, leaving the deflector 10 mounted on the studs 12 as shown in FIG. 9.

The retainer 30 may be reused by inserting additional nuts 22 into the openings of the tabs 40, and connecting the retainer 30 to another part for assembly.

A nut 22 may be left out of the assembly if desired to leave an unfastened stud 12 for connecting additional components, such as an oil pump or an oil pickup tube.

The foregoing description is directed, as an example, to assembling an oil deflector to engine studs with a retainer. However, it should be understood that other components may be joined using nut retainers similar to that described above.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A retainer for positioning and retaining flanged nuts relative to stud openings in a member for installation of the member on studs of an assembly, the retainer comprising:

a central body having a releasable attachment device for releasably attaching the retainer to the member; and a plurality of tabs extending from the body, the tabs each having an opening sized for loosely surrounding a driving portion of a nut and retaining a flanged portion of the nut between the respective tab and the member and in alignment with the stud openings during assembly;

whereby the nuts are rotatable within the tabs and loosely retained therein to allow for alignment with the studs during installation of the member on the assembly.

2. A retainer as in claim 1 wherein the retainer is made of a semi-resilient plastic material.

3. A retainer as in claim 1 wherein the attachment device includes at least one hook and a resilient latch, the hook and latch positioned at opposite ends of the body.

4. A retainer as in claim 1 wherein attachment device is molded as an integral part of the body.

5. A retainer as in claim 1 wherein the tabs are molded as an integral part of the body.

6. A retainer as in claim 1 wherein the retainer is molded as a single element.

7. A retainer assembly comprising:

a member having a body including a plurality of laterally and longitudinally spaced openings adapted to be received on a plurality of threaded studs of a larger assembly;

a plurality of fastening nuts, each including a flange at one end, a driving portion extending from the flange to an opposite end, and internally threaded openings extending between the ends through the flange into the driving portion; and a retainer comprising a central body having a releasable attachment device releasably attached to the member and nut retaining tabs extending from the central body and having openings surrounding the driving portions of the nuts and retaining the flanges between the tabs and the member with the threaded openings generally in alignment with the openings of the member, the driving portions extending through the tab openings for engagement by a nut driver.

8. An assembly as in claim 7 wherein the nuts are rotatable within the tab openings of the retainer.

9. An assembly as in claim 7 wherein the nuts are loosely contained in the tab openings to allow alignment of the nuts during tightening.

10. An assembly as in claim 7 wherein the attachment device includes at least one hook and a resilient latch engaging portions of the member body for releasably retaining the retainer on the body.

11. An assembly as in claim 7 wherein the member is an engine oil deflector.

* * * * *